US006315007B1

(12) United States Patent
Mohamed et al.

(10) Patent No.: US 6,315,007 B1
(45) Date of Patent: Nov. 13, 2001

(54) HIGH SPEED THREE-DIMENSIONAL WEAVING METHOD AND MACHINE

(75) Inventors: Mansour H. Mohamed, Raleigh; Mahmoud M. Salama, Cary, both of NC (US)

(73) Assignee: 3Tex, Inc., Cary, NC (US)

( * ) Notice: Subject to any disclaimer, the term of this patent is extended or adjusted under 35 U.S.C. 154(b) by 0 days.

(21) Appl. No.: 09/816,835

(22) Filed: Mar. 23, 2001

(51) Int. Cl.[7] ..... D03D 41/00
(52) U.S. Cl. ..... 139/11; 139/DIG. 1
(58) Field of Search ..... 139/11, DIG. 1, 139/383 R

(56) References Cited

U.S. PATENT DOCUMENTS 4,019,954 * 4/1977 Holman et al. ..... 139/20
5,085,252 * 2/1992 Mohamed et al. ..... 139/22
5,137,058 * 8/1992 Anahara et al. ..... 139/384 R
5,211,967 * 5/1993 Yasui et al. ..... 442/206
5,399,418 * 3/1995 Hartmanns et al. ..... 428/218
5,449,025 * 9/1995 Weinberg ..... 139/11
5,465,760 * 11/1995 Mohamed et al. ..... 139/11
5,833,802 * 11/1998 Yasui et al. ..... 156/510
6,003,563 * 12/1999 Uchida et al. ..... 139/11
6,105,622 * 8/2000 Sternheim et al. ..... 139/11
6,129,122 * 10/2000 Bilisik ..... 139/11
6,155,306 * 12/2000 Katsukura et al. ..... 139/11
6,186,185 * 2/2001 Kokhar ..... 139/DIG. 1

* cited by examiner

*Primary Examiner*—John J. Calvert
*Assistant Examiner*—Robert H. Muromoto, Jr.
(74) *Attorney, Agent, or Firm*—Glasgow Law Firm

(57) ABSTRACT

A method and machine for high speed formation of a three-dimensional woven fiber structure having at least two warp yarn systems having approximately zero crimp and at least three filling yarns having approximately zero crimp, wherein the warp and filling yarns are non-interlacing with each other, and are secured as an integral fabric via at least one vertical or Z yarn system and the warp yarn systems provided to be positioned via harness frames. The 3-D woven fabric of the present invention is fabricated on a 3-D weaving machine having rapier filling insertion that provides filling yarn insertions in unique shed openings in series to produce a complete filling insertion cycle for every movement of Z-direction yarn harnesses.

13 Claims, 3 Drawing Sheets

HIGH SPEED THREE-DIMENSIONAL WEAVING METHOD AND MACHINE

BACKGROUND OF THE INVENTION (1) Field of the Invention

The present invention relates generally to fabric formation and, more particularly, to a method for high speed three-dimensional woven fabric formation of structures including three substantially orthogonal yarn systems and a machine that incorporates this method.

(2) Description of the Prior Art

In general, it is known in the art to manufacture multi-layer fabrics, including three-dimensional woven fabrics, particularly for use in aerospace and industrial applications and for use in resin-infused composite structures incorporating the same. Additionally, it is known in the art to use specialized machines for making three-dimensional woven fabrics, particularly incorporating high performance fibers to improve the characteristics of the overall woven structure.

However, overall, these prior art methods and related machines are not capable of producing three-dimensional woven fabric at high speeds. While traditional weaving machines can provide high speed weaving and fabric production, these machines are not capable of providing true three-dimensional fabric structures. Typical speeds for two-dimensional weaving machines, specifically for rapier machines, are between about 200 picks per minute to about 350 picks per minute. However, these machines are only capable of producing standard two-dimensional fabrics or "crammed" fabrics that have some additional picks or filling yarns. In the case of "cramming," additional picks are inserted during a single phase of harness action such that instead of inserting a single pick during a single phase, an extra pick or so is added. Moreover, "cramming" fabric is not used for large fabric dimensions; rather, it is used primarily as a border for towels and handkerchiefs. One significant problem with "crammed" fabric is a substantial lack of stability and control within the fabric due to the addition of picks without providing a warp or other angular interlocking of the picks. Uncontrolled shrinkage and wrinkling are prevalent in areas where "crammed" fabric is used. Thus, neither the two-dimensional fabrics nor the "crammed" fabrics that can be produced from a traditional two dimensional weaving machine at high speeds can provide adequate fabric characteristics to match those of true three-dimensional fabric structures.

While prior art three-dimensional weaving machines are capable of providing true three-dimensional fabric structures, including complex-shaped structures, the machine speeds are very slow. Typical speeds for specialized three-dimensional weaving machines are about 30 insertions per minute. Also, prior art 3-dimensional weaving machines require simultaneous stack filling insertion and continuously filing yarns. Therefore, no prior art has been capable of providing a high speed means for manufacturing true three-dimensional woven fabrics having three substantially orthogonal yarn systems. Thus, there remains a need for a method and machine for producing three-dimensional woven fabrics at reasonably high speeds. Furthermore, no prior art provides a high speed method or machine for forming three-dimensional fabric structures having a range of dimensions. Thus, there remains a need for a high speed method and machine for making three-dimensional woven fabric in a range of dimensions.

SUMMARY OF THE INVENTION

The present invention is directed to a method for high speed formation of three-dimensional woven fabrics.

Additionally, the invention is directed to a machine for making the same. The invention is applicable to the products made from the method and machine described, as no other machine is capable of making these products at high speeds.

Advantageously, the invention includes a method for providing at least two warp yarn systems having approximately zero crimp and at least three filling insertions having approximately zero crimp, wherein the warp and filling yarns are non-interlacing with each other, and are secured as an integral fabric via at least one vertical or Z yarn system provided via two harness frames. As such, the present invention provides a method and machine for high speed formation of true three-dimensional woven fabric with substantially orthogonal yarn systems having superior structural uniformity and/or continuity and performance characteristics than any prior art structure or substitute. Also, the present invention provides a method of manufacturing three-dimensional fabrics in a limited range of dimensions and densities using a single fabric-forming machine with no additional equipment or separate processes required, these dimensions are limited to the rapier machine width and to fabrics having only two or three warp yarn layers.

Also, the three-dimensional woven fabrics produced by the method and machine according to the present invention are suitable for forming rigid composite structures that do not require joining, splicing, or otherwise connecting, patterning, creating cut-out regions or overlapping material to form the final structure, shape or dimensions in order to conform to a predetermined shaped structure or component. Also, the shaped three-dimensional fabric structure may be formed into a rigid composite structure via the addition of a resin or similar hardening material.

Accordingly, one aspect of the present invention is to provide a method for high speed formation of three-dimensional woven fabric structures by providing at least two warp yarn systems having approximately zero crimp and at least three filling insertions having approximately zero crimp, wherein the warp and filling yarns are non-interlacing with each other, and are secured as an integral fabric via at least one vertical or Z yarn system provided via two harness frames. Another aspect of the present invention is to provide a high speed machine for forming three-dimensional woven fabric structures by providing a rapier machine that is modified to include at least two distinct warp yarn systems having approximately zero crimp and at least three filling insertions having approximately zero crimp per insertion cycle or series, wherein the warp and filling insertions are non-interlacing with each other, and are secured as an integral fabric via at least one vertical or Z yarn system provided via two harness frames. Additionally, it is an aspect of the present invention to provide a three-dimensional woven fabric structure formed via the high speed method and machine according to the present invention.

Other objects and advantages of the present invention will become apparent to those skilled in the art after a reading of the following description of the preferred embodiment and the accompanying drawings, which are merely illustrative of such invention.

DETAILED DESCRIPTION OF THE PREFERRED EMBODIMENTS

Figure 1:
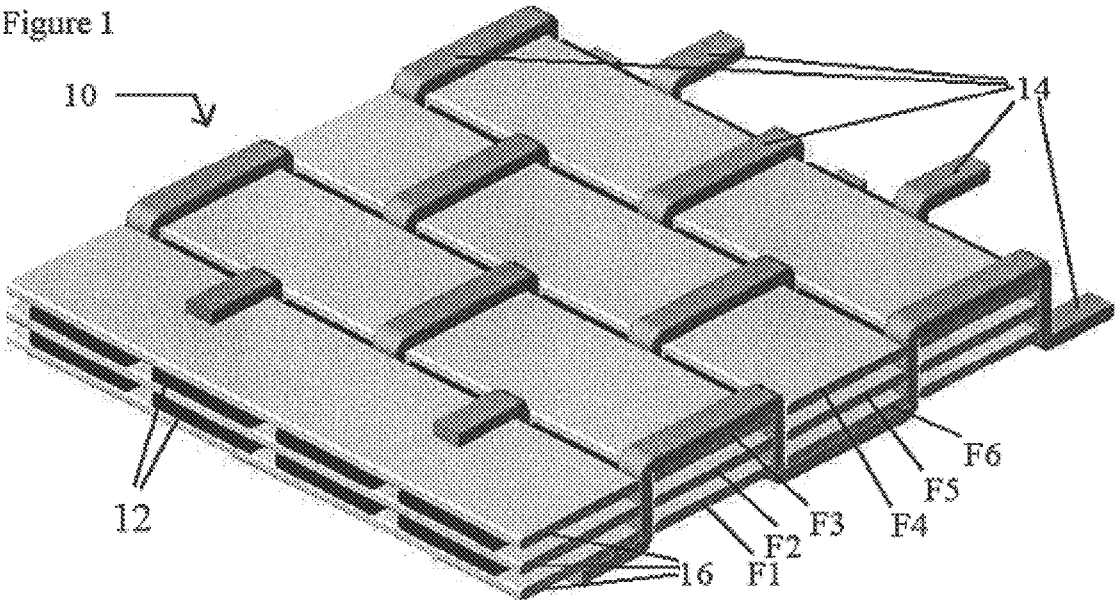
FIG. 1 is a perspective view of a fabric produced via the method of the preferred embodiment produced according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and to FIG. 1 in particular, it will be understood that the illustrations are for the purpose of describing a preferred embodiment of the invention and are not intended to limit the invention thereto.

A complete disclosure of a traditional, true orthogonal three-dimensional fabric forming method is provided in U.S. Pat. No. 5,085,252 and U.S. Pat. No. 5,465,760, both owned by the present applicant and/or assignee, and incorporated herein by reference in their entirety.

Referring now to FIGS. 2A–2F, a process schematic diagram of a three-dimensional (3-D) weaving arrangement having at least two warp or X-direction yarn systems, at least three filling insertions, each having a Y-direction yarn pairing, per insertion cycle or series, and at least one vertical or Z-direction yarn system using at least two harness frames is shown according to the present invention.

The process includes providing at least two X-direction warp yarn systems drawn through at least 2 harnesses having approximately zero crimp and at least three Y-direction filling insertions including a pair of filling yarns in each insertion having approximately zero crimp, wherein the warp and filling yarns are non-interlacing with each other. Introducing each of the at least three filling insertions in series, each introduced within a unique shed opening and separated by a plane of X-direction warp yarns, the insertions forming a substantially vertical alignment with each other. Completing a filling insertion cycle without advancing the X-direction warp yarns. Advancing a reed in a beat-up motion toward a fabric being formed by the yarns, wherein each filling insertion is followed by the reed beat-up and changing the position of the X-direction harnesses controlling the X-direction warp yarns to form a new shed opening. Changing the position of the Z-direction yarns by moving the Z-direction harnesses to cross each other from top to bottom and vice versa. Advancing the warp yarn systems at a predetermined rate coordinated with a fabric take-up rate. Securing the X-direction warp yarns and Y-direction filling insertions together an integral fabric via at least one vertical or Z yarn system provided via two harness frames. Repeating the previous steps, thereby forming a 3-dimensional orthogonal woven fabric.

FIG. 1 is a perspective view of a fabric produced according to the method of the preferred embodiment produced according to the present invention, namely a 3-D orthogonal woven structure, generally referenced 10, wherein the arrangement shows two warp layers forming the X-direction yarn system 12, six harnesses 20 (shown in FIG. 2) four for controlling and guiding X-direction yarns 12 and two for controlling and guiding Z-direction yarn systems 14, more specifically, four harness sets for the X-direction yarns (W1, W2), two harness sets for the Z-direction yarn systems (Z1, Z2), and three filling insertion layers 16 forming the Y-direction yarn system. The X-direction and Y-direction yarns are non-interlacing and are layered vertically at substantially right angles to each other.

Importantly, the modified weaving machine and method according to the present invention require not more than three warp layers and four filling insertion layers; preferably, the best embodiment for the modified weaving machine and method according to the present invention require two warp layers and three filling layers. Increasing the number of layers of warp (X-direction) and filling insertion (Y-direction) layers slows the process substantially such that the modified machine and method do not produce at substantially high speeds.

According to the present invention, the X-direction yarn system and Y-direction yarn systems are non-interlacing, that is, no interlacing cross-over points occur when the two systems are introduced to form two of the three substantially orthogonal yarn systems in the fabric body. Also, the Y-direction yarn system and the Z-direction yarn system can be balanced or non-balanced. As shown in FIG. 1, the Z-direction yarn system provides the structural separation and control of position between the X- and Y-direction yarn systems during weaving and in the finished woven structure.

The process by which the three-dimensional woven fabric is formed at high speed according to the present invention will now be generally described with reference to the schematic shown in FIGS. 2A–2F. Lengthwise or in the X-direction, the warp yarns 12 are drawn in under tension from a warp and tension system (not shown) between the heddles of harnesses W1 to W4, and through a beat up reed 18 and to the fabric formation zone 22. Crosswise or in the Y-direction, the filling insertion 16 or sets of filling yarns F1, F2, F3, F4, F5, F6 are inserted between the warp layers using fill insertion means, preferably a rapier system of a modified rapier machine (not shown) using fill insertion rapiers modified to carry paired filling yarns simultaneously in one pick. In a preferred embodiment, neither the X-direction nor the Z-direction harnesses cross for every filling insertion, rather the Z-direction yarns cross for every completed filling insertion cycle comprising three filling insertions F1, F2, F3 and/or F4, F5, F6 in the sections of the fabric to form the main body of the fabric 32. In the preferred embodiment, a completed filling insertion cycle includes two warp or X-direction yarn layers that run parallel to each other in spaced apart configuration as shown in FIGS. 2A–2F and three filling insertion or Y-direction layers having two yarns per filling insertion or pick, wherein the three filling insertions are inserted in a vertically parallel, spaced apart configuration shown in FIGS. 2A–2F within a unique shed for each pick F1, F2, F3, F4, F5, F6, as shown, and a single motion cycle of the Z-direction yarn harnesses for each cycle F1, F2, F3 and/or F4, F5, F6. The warp advance and fabric take-up are coordinated to activate only after a filling insertion cycle is completed; a filling insertion cycle, including three filling insertions F1, F2, F3 and/or F4, F5, F6 provides a half fabric repeat cycle or one weaving cycle.

Referring again to FIGS. 2A–2F, during the weaving process, harnesses Z1, Z2, which are carrying Z-direction yarns, cross for every fill insertion cycle to the bottom and top parts, respectively. This method provides a traditional 3-D weaving pattern, wherein there is not separation between top and bottom parts, i.e., the entire fabric has an integral, unitary woven construction, as shown in FIG. 1.

During the weaving process according to the present invention, as best shown in FIGS. 2A–2F, when the Z-direction yarn system components are in an "open" position wherein select, predetermined harnesses Z1, Z2 and W1, W2 are raised or lowered in pairs respectively to form an angular opening or shed opening between the X-direction yarn systems and the Z-direction yarns, thereby forming a unique shed opening for each filling insertion, then a filling insertion or filling yarn pair is inserted therebetween. In the preferred embodiment according to the present invention, one filling insertion having two filling yarns is inserted between each layer of X-direction or warp yarns to provide at least three filling yarns in a substantially vertical, stacked and spaced-apart arrangement wherein each filling yarn is separated from another by a layer of X-direction or warp yarns.

Referring now to FIGS. 2A–2F, which illustrates an 3-D weaving process schematic according to the present invention, there is movement of the X-, Y-, and Z-yarn systems in a coordinated and non-interlacing manner, as compared with prior art weaving. In FIGS. 2A–2F, two Z-direction yarn harnesses are used in the configuration according to the present invention.

Figure 2A:
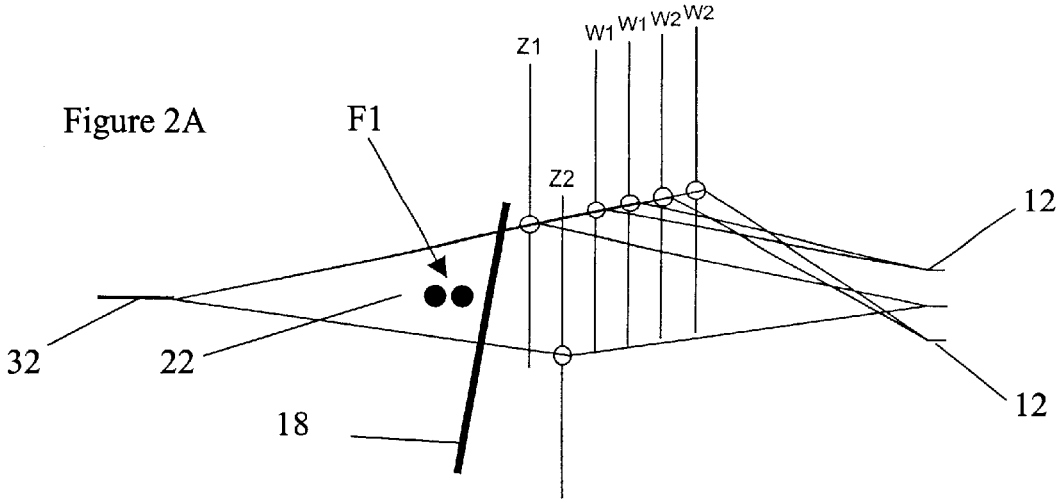
FIGS. 2A, 2B, 2C, 2D, 2E, and 2F are schematic representations of a 3-D orthogonal weaving method according to the present invention.
Figure 2B:
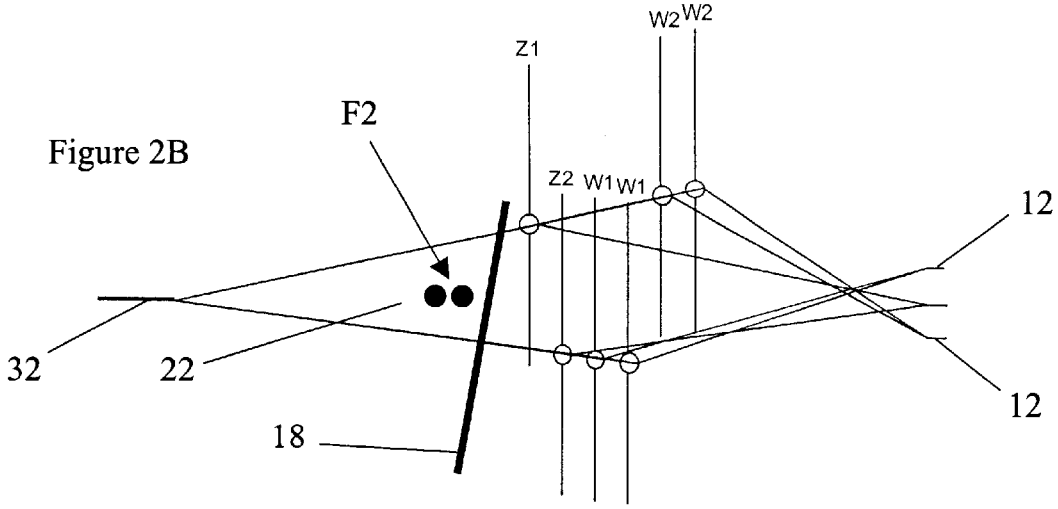
Figure 2C:
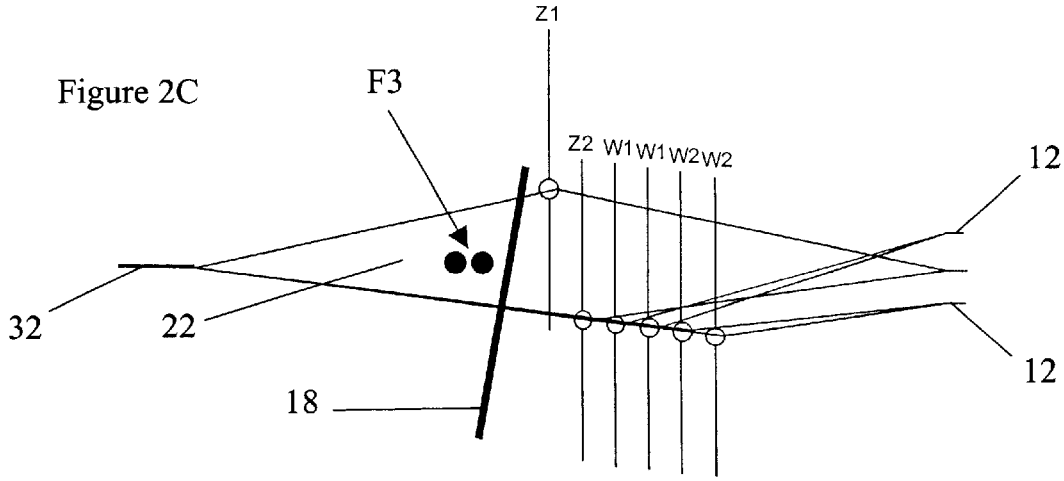
Figure 2D:
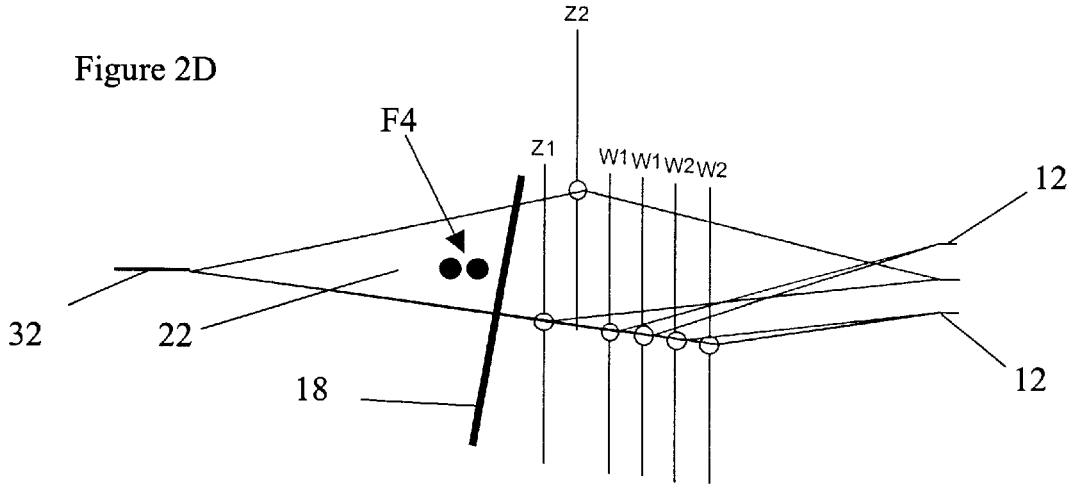
Figure 2E:
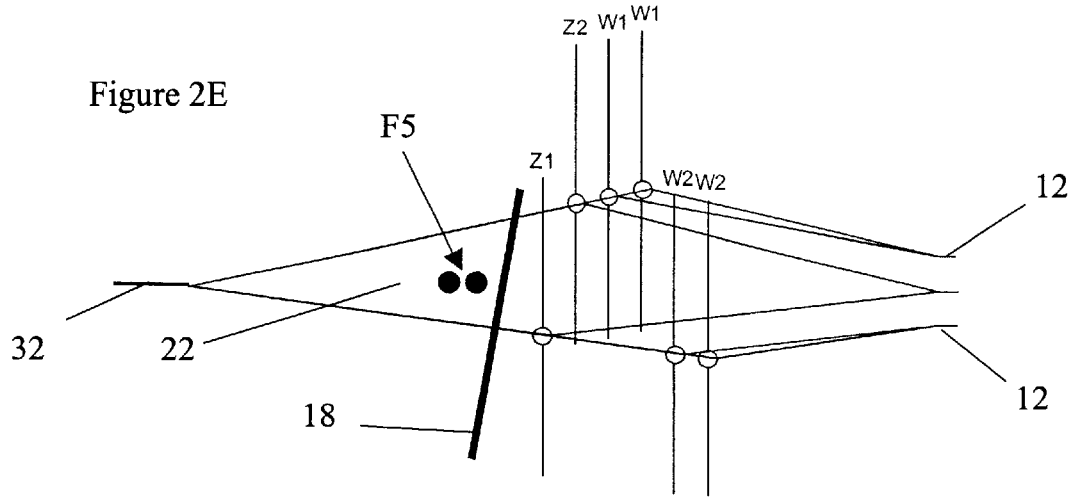
Figure 2F:
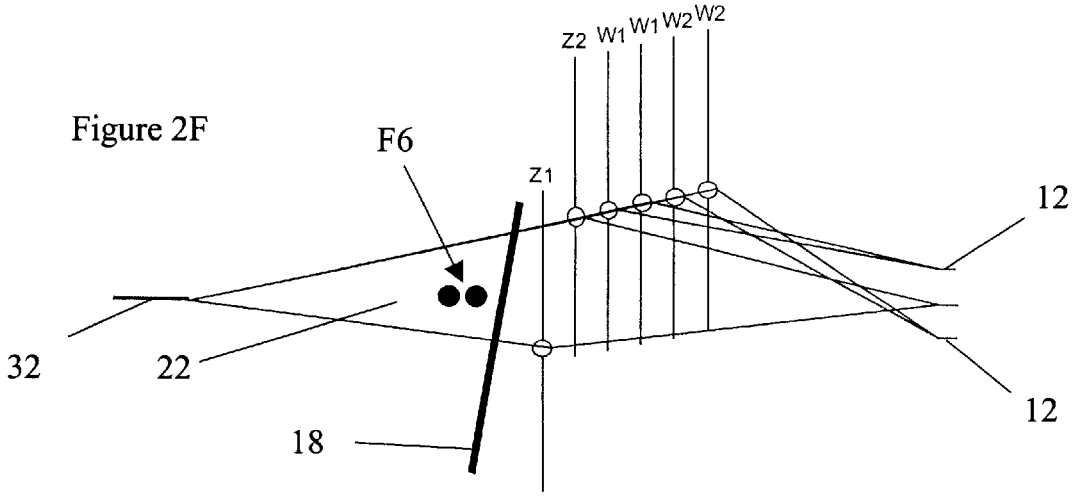

In the preferred embodiment according to the present invention using two X-direction, two Z-direction, and three Y-direction, a complete fill insertion cycle consists of three steps and is described as follows: for pick #1, as shown in FIG. 2A, the Z-direction yarn in harness Z1 and the X-direction yarns in harnesses W1 and W2 are positioned up and the Z-direction yarn in harness Z2 is positioned down to form an open shed for the introduction or insertion of the first Y-direction filling insertion yarns F1. The Y-direction filling insertion yarns F1 are inserted across the width of the machine by a rapier and each end of the Y-direction yarns is cut to form a finite component. Beat-up by the reed 18 then occurs. Subsequently for pick #2, as shown in FIG. 2B, the Z-direction direction yarn in harness Z1 and the X-direction yarns in harnesses W2 are positioned up, the Z-direction yarn in harness Z2 and the X-direction yarns in harnesses W1 are positioned down to form an open shed for the introduction or insertion of the second Y-direction filling insertion yarns F2. The Y-direction filling insertion yarns F2 are inserted across the width of the machine by a rapier and each end of the Y-direction yarns is cut to form a finite component. Beat-up by the reed 18 then occurs. Subsequently for pick #3, as shown in FIG. 2C, the Z-direction yarn in harness Z1 is positioned up and the Z-direction yarn in harness Z2, the X-direction yarns in harnesses W1 and W2 are positioned down to form an open shed for the introduction or insertion of the third Y-direction filling insertion yarns F3. The Y-direction filling insertion yarns F3 are inserted across the width of the machine by a rapier and each end of the Y-direction yarns is cut to form a finite component. Beat-up by the reed 18 then occurs. Take-up then occurs, wherein take-up consists of advancing the X-direction warp yarns by adjusting the warp yarn system drums and a take-up roll in coordinated rotational movement until a filling insertion cycle is completed. For the next fill insertion cycle, the positions of the Z-direction harnesses Z1 and Z2 are reversed, and the cycle occurs as follows: for pick #4, as shown in FIG. 2D, the Z-direction yarn in harness Z2 is positioned up and the Z-direction yarn in harness Z1, the X-direction yarns in harnesses W1 and W2 are positioned down to form an open shed for the introduction or insertion of the fourth Y-direction filling insertion yarns F4. The Y-direction filling insertion yarns F4 are inserted across the width of the machine by a rapier and each end of the Y-direction yarns is cut to form a finite component. Beat-up by the reed 18 then occurs. Subsequently for pick #5, as shown in FIG. 2E, the Z-direction yarn in harness Z2 and the X-direction yarns in harnesses W1 are positioned up and the Z-direction yarn in harness Z1 and the X-direction yarns in harnesses W2 are positioned down to form an open shed for the introduction or insertion of the fifth Y-direction filling insertion yarns F5. The Y-direction filling insertion yarns F5 are inserted across the width of the machine by a rapier and each end of the Y-direction yarns is cut to form a finite component. Beat-up by the reed 18 then occurs. Subsequently for pick #6, as shown in FIG. 2F, the Z-direction yarn in harness Z2 and the X-direction yarns in harnesses W1 and W2 are positioned up and the Z-direction yarn in harness Z1 is positioned down to form an open shed for the introduction or insertion of the sixth Y-direction filling insertion yarns F6. The Y-direction filling insertion yarns F6 are inserted across the width of the machine by a rapier and each end of the Y-direction yarns is cut to form a finite component. Beat-up by the reed 18 then occurs. Take-up then occurs.

Significantly, the rapier system of the machine required modification to reasonably handle each filling insertion having two filling yarns, particularly since the yarns were high performance fibers selected from the group consisting of Keel, fiberglass, and carbon. This provides for high speed production of an orthogonal 3D woven structure according to the present invention.

Also, a tension compensation system for X-, Y-, and Z-direction yarns is constructed and arranged to maintain tension levels during weaving process. As each Y-direction yarn is inserted between layers of X-direction yarns for each filling insertion step within a complete filling insertion cycle, the Y-direction yarn is maintained under at least a minimum tension supplied between the yarn supply packages and the rapier. Also, the X-direction yarn systems are maintained under a tension system incorporating the warp beam(s) and take-up roll. The X-direction or warp yarns are advanced only after a complete Y-direction yarn insertion cycle is completed. Each Y-direction yarn insertion cycle includes at least three Y-direction yarn insertions aligned in a substantially vertical, spaced apart columnar arrangement separated by X-direction or warp yarn layers. Additionally, as the Z-direction yarns move and are subject to the tension compensation system, the length of the Z-direction yarns also changes, thus making the tension control necessary. Typically, tension ranges for the tension compensation system are between about 20 gram to 400 gram, depending upon the type and tow size of Z-direction yarns used in the structure, fabric thickness, the number of warp layers, and other process parameters.

Beneficially, uniformity exists throughout the entire body of the woven fabric shown in FIG. 1, thus providing a fabric having consistent and reasonably predictable properties. Therefore, in contrast with the prior art for two-dimensional and "crammed" fabric structures, the present invention provides uniform and controlled distribution and arrangement of each of the yarns in each yarn system throughout the woven fabric body. Also according to prior art three-dimensional weaving methods, each of the filling insertions 16 is inserted simultaneously in a continuous looped configuration; whereas the method according to the present invention provides a staggered, separate and serial introduction of each Y-direction yarn pair in each filling insertion cycle, thereby providing for rapid introduction of filling and high speed three-dimensional weaving.

In a preferred embodiment of the present invention, the three-dimensional woven fabrics have two or three X-direction yarn warp layers. The warp ends are between 1.5 to 12 ends per cm per layer. The fill insertion per unit length is between 1.5 to 12 insertions per cm. Also, in a preferred embodiment, the three-dimensional woven fabrics have three or four Y-direction yarn filling layers, respectively to the number of X-direction warp layers, separated by the warp layers. The combination of three layers of Y-direction yarn filling layers separated by two X-direction yarn warp layers creates a fabric referred to as "2.5" as calculated from the average of the X- and Y-direction yarn layers. Similarly, the combination of four layers of Y-direction yarn filling layers separated by three X-direction yarn warp layers creates a fabric referred to as "3.5" as calculated from the average of the X- and Y-direction yarn layers.

In one embodiment according to the present invention, the three-dimensional (3-D) fabric according to the present invention is formed of at least one high-performance fiber array within a three-dimensional weave construction, which has at least two warp layers but not more than three warp layers. The 3-D fabric is engineered and constructed to form a predetermined structure, namely either a 2.5 or 3.5 rectangular cross-sectional 3-D woven fabric. The dimensions of the overall structure and of the cross-section can be varied, based upon the desired size of the fabric and the dimensions of the rapier weaving machine on which the fabric is being manufactured. Significantly, modifications to the 3-D weaving machine and process for manufacturing various width dimensions, without requiring major modifications to the 3-D weaving machine and method according to the present invention, wherein each filling insertion or filling yarn pair is inserted individually and cut into a predetermined length equal or greater to the finished fabric width and no warp or take-up roll(s) advance until the entire filling insertion cycle is completed.

Speeds possible with the method and machine according to the present invention are between about 150 to about 350 individual Y-direction yarn insertions per minute, preferably between about 250 to about 300 individual Y-direction yarn insertions per minute. Thus, for example, in a fabric having three Y-direction yarn insertions per filling insertion cycle, the weaving speed would be between about 50 to about 117 insertion cycles per minute, preferably between about 80 to about 100 insertion cycles per minute. Also by way of example, in a fabric having five Y-direction yarn insertions per filling insertion cycle, the weaving speed would be between about 30 to about 70 insertion cycles per minute, preferably between about 50 to about 60 insertion cycles per minute.

The method and machine according to the present invention is capable of producing a limited range of rectangular cross-sectioned 3-D woven fabrics, as illustrated in FIG. 1, generally referenced 10, which shows three substantially perpendicular yarn systems, respectively positioned in an X direction, a Y direction, and a Z direction, as shown. The 3-D woven fabric includes at least one high performance fiber array in one of the X, Y, or Z directions. In a preferred embodiment the warp direction, or X direction, comprises high performance fibers selected from the group consisting of carbon, Kevlar, and fiberglass. Alternatively, the Y and Z directions also include similar high performance fibers for increased impact resistance, strength, shear strength, compression characteristics, enhanced resistance to delamination, and overall uniformity and structural integrity.

In one embodiment, the fabric is formed of high-performance fiber selected from the group consisting of Kevlar, fiberglass, carbon, and the like. Other high-performance fibers having a tensile strength of greater than about 5 grams per denier may be used; preferably, the high performance fibers have a tensile strength of greater than 7 grams per denier.

Fabric dimensions according to the present invention may vary, preferably the width of the finished fabric is between about 20 to about 70 inches wide, more preferably about 50 to about 64 inches wide in the Y-direction. Formerly, traditional true 3-D woven fabrics could only be produced in dimensions of up to 20 inches wide, due to machine and method restrictions for the configuration wherein all filling insertions of Y-direction yarns are made simultaneously for a given cycle. Thus, the present invention advantageously permits higher speed filling insertions and greater fabric widths by adopting individual filling yarn insertions that in series produce a single filling insertion cycle.

The present invention is directed to a method for high speed formation of a 3-dimensional woven fabric, specifically in a preferred embodiment a two layer X-direction and three layer Y-direction configuration, for aerospace and industrial applications of the finished fabrics and composites made therefrom, including the steps set forth in the foregoing of providing at least two warp yarn systems having approximately zero crimp and at least three filling yarns having approximately zero crimp, wherein the warp and filling yarns are non-interlacing with each other, and are secured as an integral fabric via at least one vertical or Z yarn system provided via two harness frames; introducing each of the at least three filling yarns to form a complete filling insertion cycle without advancing the X-direction warp yarns; changing the position of the Z-direction yarns by moving the harnesses to cross each other from top to bottom and vice versa; advancing the warp yarn systems at a predetermined rate; and repeating the previous steps, thereby forming a 3-dimensional woven fabric at high speed and large dimensions.

Certain modifications and improvements will occur to those skilled in the art upon a reading of the foregoing description but are not included for the sake of conciseness. By way of example, take-up may occur prior to change in Z-direction harness position or afterward without substantially affecting the final product or process speeds. It should be understood that all such modifications and improvements have been deleted herein for the sake of conciseness and readability but are properly within the scope of the following claims.

The present invention may, of course, be carried out in other specific ways than those set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

We claim:

1. A method for forming a three-dimensional woven fiber structure comprising the steps of:

providing at least two X-direction warp yarn systems drawn through at least 2 harnesses having approximately zero crimp and at least three Y-direction filling insertions including a pair of filling yarns in each insertion having approximately zero crimp, wherein the warp and filling yarns are non-interlacing with each other;

introducing each of the at least three filling insertions in series, each introduced within a unique shed opening and separated by a plane of X-direction warp yarns, the insertions forming a substantially vertical alignment with each other;

completing a filling insertion cycle without advancing the X-direction warp yarns;

advancing a reed in a beat-up motion toward a fabric being formed by the yarns, wherein each filling insertion is followed by the reed beat-up and changing the position of the X-direction harnesses controlling the X-direction warp yarns to form a new shed opening;

changing the position of the Z-direction yarns by moving the Z-direction harnesses to cross each other from top to bottom and vice versa;

advancing the warp yarn systems at a predetermined rate coordinated with a fabric take-up rate;

securing the X-direction warp yarns and Y-direction filling insertions together an integral fabric via at least one vertical or Z yarn system provided via two harness frames; and repeating the previous steps, thereby forming a 3-dimensional orthogonal woven fabric.

2. The method according to claim 1, wherein the structure comprises at least three yarn systems, one each in an X, Y, and Z direction, thereby forming a substantially orthogonal 3-D woven structure.

3. The method according to claim 1, wherein the structure is formed from at least one high performance fiber type.

4. The method according to claim 1, wherein the structure is formed using at least two Z-direction harnesses for controlling the Z-direction yarn positions to form the unique shed opening for each filling insertion cycle.

5. The method according to claim 1, wherein the structure is formed using at least two Z-direction harnesses for controlling the Z-direction yarn positions to form the unique shed opening for each filling insertion.

6. The method according to claim 1, wherein the three-dimensional fabric dimensions include a Y-direction width between about 20 to about 70 inches wide.

7. The method according to claim 1, wherein the three-dimensional fabric dimensions include a Y-direction width between about 50 to about 64 inches wide.

8. The method according to claim 1, wherein the Y-direction layers are three layers and the X-direction layers are two layers.

9. The method according to claim 1, wherein the Y-direction layers are four layers and the X-direction layers are three layers.

10. The method according to claim 1, wherein the Y-direction filling insertions are made at a speed between about 150 to about 350 Y-direction insertions per minute.

11. The method according to claim 1, wherein the Y-direction filling insertions are made at a speed between about 250 to about 300 Y-direction insertions per minute.

12. The method according to claim 1, further including the steps of providing the Z-direction yarns in two harnesses Z1, Z2 and the X-direction yarns in harnesses W1 and W2;

positioning the Z-direction yarns in harness Z1 and the X-direction yarns in harnesses W1 and W2 in an UP position and the Z-direction yarns in harness Z2 in a DOWN position thereby forming a first open shed for the introduction of a first Y-direction filling insertion F1;

inserting the Y-direction filling insertion yarns F1 via a rapier system across the width of the weaving machine and cutting each end of the Y-direction filling insertion to form a finite filling insertion F1;

activating a reed beat-up against the fabric being formed by the yarns;

positioning the Z-direction yarn in harness Z1 and the X-direction yarns in harnesses W2 in an UP position, and positioning the Z-direction yarn in harness Z2 and the X-direction yarns in harnesses W1 in a DOWN position to form a second open shed for the introduction of a second Y-direction filling insertion F2;

inserting the second Y-direction filling insertion F2 via a rapier system across the width of the weaving machine and cutting each end of the Y-direction filling insertion to form a finite filling insertion F2;

activating a reed beat-up against the fabric being formed by the yarns;

positioning the Z-direction yarn in harness Z1 in an UP position and positioning the Z-direction yarn in harness Z2 and the X-direction yarns in harnesses W1 and W2 in a DOWN position to form an open shed for the introduction or insertion of the third Y-direction filling insertion yarns F3;

inserting a third Y-direction filling insertion F3 via a rapier system across the width of the weaving machine and cutting each end of the Y-direction insertions filling insertion to form a finite filling insertion F3;

activating a reed beat-up against the fabric being formed by the yarns;

activating warp advance and coordinated take-up of fabric after the completion of the filling insertion cycle including completed filling insertion of the first, second, and third filling insertion in a spaced-apart, vertically aligned position within the fabric;

reversing the positions of the Z-direction harnesses Z1 and Z2;

positioning the Z-direction yarn in harness Z2 in the UP position and positioning the Z-direction yarn in harness Z1 and the X-direction yarns in harnesses W1 and W2 in the DOWN position to form an open shed for the introduction of the fourth Y-direction filling insertion F4;

inserting a fourth Y-direction filling insertion F4 via a rapier system across the width of the weaving machine and cutting each end of the Y-direction filling insertion to form a finite filling insertion F4;

activating a reed beat-up against the fabric being formed by the yarns;

positioning the Z-direction yarn in harness Z2 and the X-direction yarns in harnesses W1 in the UP position and positioning the Z-direction yarn in harness Z1 and the X-direction yarns in harnesses W2 in the DOWN position to form an open shed for the introduction of a fifth Y-direction filling insertion yarns F5;

inserting the fifth Y-direction filling insertion F5 via a rapier system across the width of the weaving machine and cutting each end of the Y-direction filling insertion to form a finite filling insertion F5;

activating a reed beat-up against the fabric being formed by the yarns;

positioning the Z-direction yarn in harness Z2 and the X-direction yarns in harnesses W1 and W2 in the UP position and the Z-direction yarn in harness Z1 in a DOWN position to form an open shed for the introduction or insertion of the sixth Y-direction filling insertion F6;

inserting the sixth Y-direction filling insertion F6 via a rapier system across the width of the weaving machine and cutting each end of the Y-direction filling insertions to form a finite filling insertion F6;

activating a reed beat-up against the fabric being formed by the yarns;

activating warp advance and coordinated take-up of fabric after the completion of the filling insertion cycle including completed filling insertion of the fourth, fifth, and sixth filling insertion in a spaced-apart, vertically aligned position within the fabric;

reversing the positions of the Z-direction harnesses Z1 and Z2;

repeating the fabric repeat cycle, which includes all of the steps listed herein.

13. A machine for producing a high speed three-dimensional woven fabric structure comprising a modified rapier weaving loom configured to provide at least two warp yarn systems having approximately zero crimp;

at least three filling insertions per insertion cycle, wherein each filling insertion includes a filling yarn pair having approximately zero crimp, and wherein the warp and filling insertions are positioned in alternating, orthogonal layers and the warp and filling insertions are non-interlacing with each other;

at least one vertical or Z yarn system provided via at least two harness frames that are moved to secure the warp and filling yarns to form an integral fabric; whereby each of the at least three filling yarn pairs in a filling insertions is introduced within a unique shed opening to form a complete filling insertion cycle without advancing the X-direction warp yarns by adjusting the warp yarn system drums and a take-up roll in coordinated rotational movement until a filling insertion cycle is completed; and a tension system for advancing the warp yarn systems at a predetermined rate coordinated with a take-up for fabric, wherein the take-up and warp advance is activated at the completion of a filling insertion cycle, which is half a fabric pattern repeat cycle, thereby providing a machine for high speed formation of a 3-dimensional woven fabric at high speed and large dimensions.

* * * * *